US006536395B1

(12) United States Patent
Schliemann

(10) Patent No.: US 6,536,395 B1
(45) Date of Patent: Mar. 25, 2003

(54) MEMBRANE CARBURETOR ARRANGEMENT IN A WORK APPARATUS HAVING AN INTERNAL COMBUSTION ENGINE

(75) Inventor: Harald Schliemann, Waiblingen (DE)

(73) Assignee: Andreas Stihl AG & Co., Waiblingen (DE)

( * ) Notice: Subject to any disclaimer, the term of this patent is extended or adjusted under 35 U.S.C. 154(b) by 51 days.

(21) Appl. No.: 09/671,611

(22) Filed: Sep. 28, 2000

(30) Foreign Application Priority Data

Sep. 29, 1999 (DE) ..... 199 46 574

(51) Int. Cl.[7] ..... F02M 19/00
(52) U.S. Cl. ..... 123/184.46
(58) Field of Search ..... 123/198 E, 195 C, 123/195 A, 184.46, 184.39, 184.32, 184.23, 41.65, 41.07

(56) References Cited

U.S. PATENT DOCUMENTS 4,787,924 A * 11/1988 Nagashima et al. .... 123/198 E
4,788,951 A * 12/1988 Nagashima ..... 123/198 E
5,073,307 A * 12/1991 Langer et al. ..... 261/35
5,522,355 A * 6/1996 Uhl ..... 123/198 E
5,595,153 A * 1/1997 Hoppner et al. ..... 123/198 E

FOREIGN PATENT DOCUMENTS

DE 3741018 6/1988

* cited by examiner

*Primary Examiner*—Gene Mancene
*Assistant Examiner*—Hyder Ali
(74) *Attorney, Agent, or Firm*—Walter Ottesen

(57) ABSTRACT

The invention is directed to a carburetor arrangement in a work apparatus having an internal combustion engine (2). The inlet channel (7) of the engine is connected via a connecting tube (8) to the intake channel section (9) of the membrane carburetor (4). The connecting tube (8) projects through a partition wall (3) arranged between the engine (2) and the carburetor (4). The carburetor (4) is fixed against the partition wall (3). Also, an intake air filter (70) is provided and supplies combustion air. The intake air filter is connected to the end (19) of the intake channel section (9) facing away from the partition wall (3). An attachment of the carburetor is provided without tools in that the carburetor is held clamped in the longitudinal direction of the intake channel section (9) between the partition wall (3) and a wall (22) of the air filter housing (20).

19 Claims, 6 Drawing Sheets

MEMBRANE CARBURETOR ARRANGEMENT IN A WORK APPARATUS HAVING AN INTERNAL COMBUSTION ENGINE

BACKGROUND OF THE INVENTION

In carburetor arrangements in work apparatus such as motor-driven chain saws, blowers, brushcutters, cutoff machines or the like, the carburetor is customarily arranged in a carburetor compartment of the apparatus housing and is tightly secured with threaded fasteners by means of stud bolts on a partition wall between the carburetor and the engine.

German patent publication 3,741,018 discloses such a carburetor arrangement in a motor-driven chain saw. The end of the carburetor which faces away from the partition wall is fixed additionally with an attachment piece of sheet metal. This piece of sheet metal functions to fix the filter element of the intake air filter at the same time by means of an attachment screw. The intake air filter is connected at the end of the carburetor facing away from the partition wall to the intake channel section and is fixed tightly to the housing. A carburetor arrangement of this kind is complex and is difficult to assemble and disassemble. To disassemble the carburetor, the attachment sheet metal has to be loosened and the nuts threadably engaging the stud bolts must be removed. The stud bolts are made of metal because of the acting forces whereby a certain heat transfer from the engine to the carburetor must be accepted.

An unwanted warming of the carburetor can, however, lead to the formation of vapor bubbles in the fuel-filled chambers which, in turn, can lead to operational disturbances because of a leaning of the mixture supplied to the engine.

SUMMARY OF THE INVENTION

It is an object of the invention to provide a simple carburetor arrangement which can be assembled and disassembled essentially without work tools.

The carburetor arrangement of the invention is for a work apparatus with an internal combustion engine having an inlet channel. The carburetor arrangement includes: an apparatus housing defining a space for mounting the engine therein; a carburetor having an intake channel extending therethrough and the intake channel defining a longitudinal axis; a partition wall disposed between the engine and the carburetor and the carburetor being positioned on the partition wall; the intake channel having a first end facing toward the partition wall and a second end facing away from the partition wall; a connecting tube projecting through the partition wall to connect the inlet channel of the engine to the intake channel of the carburetor at the first end thereof; an intake air filter communicating with the second end of the carburetor for conducting combustion air thereto; an additional wall; and, means for clamping and holding the carburetor between the partition and additional walls in the direction of the longitudinal axis.

The invention is based on the basic idea to fix a carburetor, which is to be mounted on an engine, by clamping the carburetor between two walls fixed in the housing without separate attachment elements.

The carburetor is advantageously pressed against the partition wall between the engine and the carburetor in that the carburetor is loaded by an additional wall with a clamping force.

The additional wall is preferably a wall of the intake air filter housing which can be clipped on the apparatus housing without separate attaching means. For this purpose, the air filter housing is pivotally hooked into a mounting location fixed with respect to the housing and is latched fixedly to the housing via a latch connection which latches in the mounted position. In further embodiments of the invention, the latching is achieved via a tension spring or a threaded fastener connection.

The air filter housing is advantageously held in the mounted position via a pivot arm so that the mounted position can be provided fixed to the housing at a suitable location of the work apparatus independently of the mounting arrangement of the air filter housing. The latching arrangement is advantageously formed by a simple latch hook, which can engage especially behind a latch edge of the partition wall and is provided on the end of a latching arm. Latching can be provided at a suitable location within the housing via the latching arm. Furthermore, considerable clamping forces can be built up via the pivot arm and the latching arm or via the tension spring because of elastic deformation. The clamping forces ensure a secure holding of the carburetor between the partition wall and the air filter housing. For this purpose, the air filter housing, its pivot arm, and the latching arm with the latching hook are made of plastic and are especially made as one piece of plastic.

Centering means, which engage in corresponding centering openings of the carburetor, are mounted on at least one wall in order to ensure a position-correct alignment of the carburetor relative to the connecting pipe, which is held in the partition wall, as well as relative to the flow opening in the air filter housing. The centering means are advantageously provided on both walls between which the carburetor is held. It can be advantageous to provide the centering means for engaging in walls on the carburetor itself.

In a further embodiment of the invention, the carburetor is held by guide bolts on the partition wall. These guide bolts engage in bores of the carburetor. For assembly, the carburetor is threaded onto the guide bolts and is clamped by the air filter housing which is then latched onto the apparatus housing. The carburetor is then reliably held between the wall of the filter housing and the partition wall.

The guide bolts and the partition wall are preferably made as one piece from plastic to avoid a heat conduction between the engine and the carburetor.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
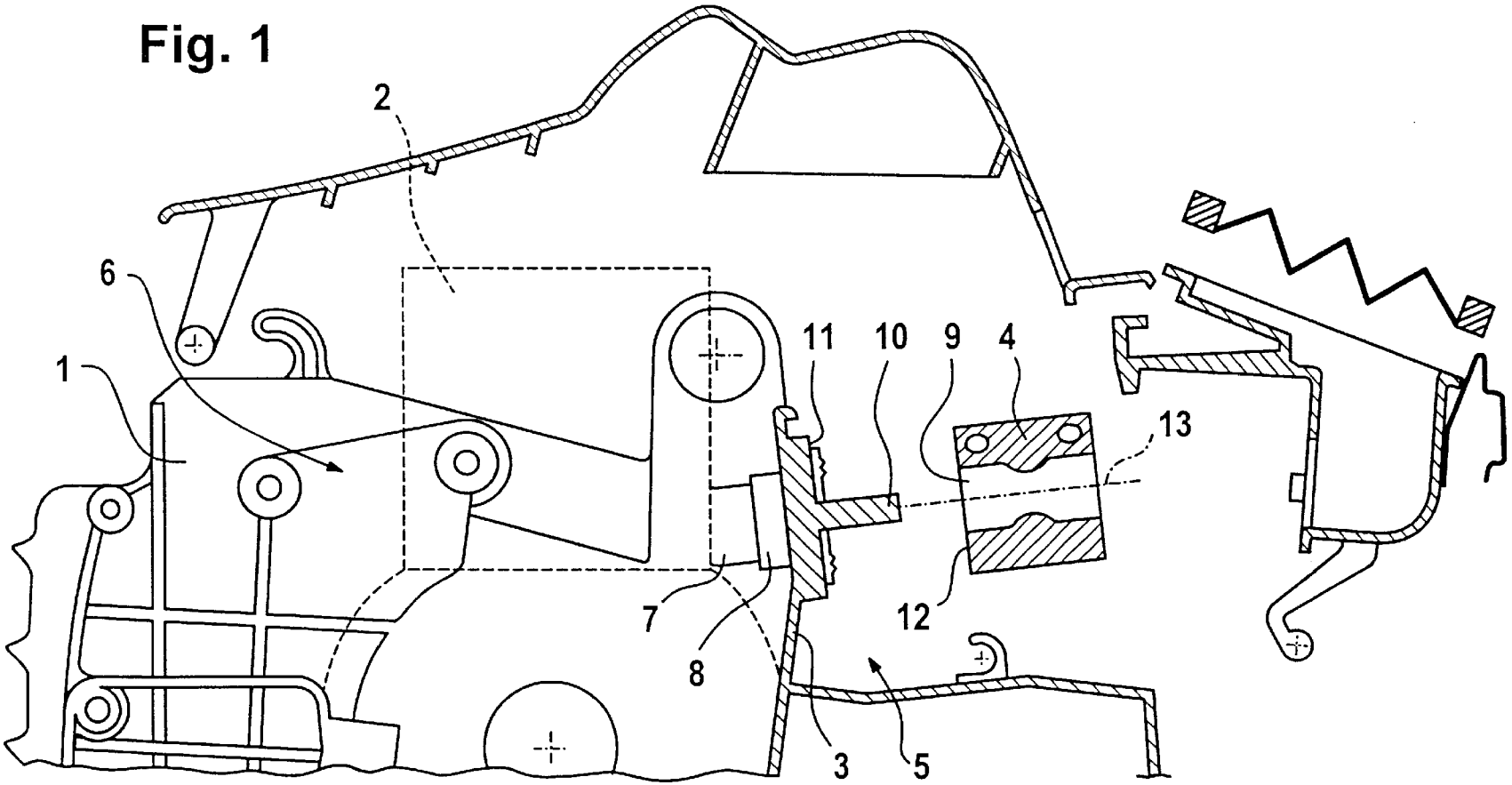
FIG. 1 is an exploded side elevation view showing a portion of an engine housing with an internal combustion engine as well as a carburetor arrangement.
Figure 2:
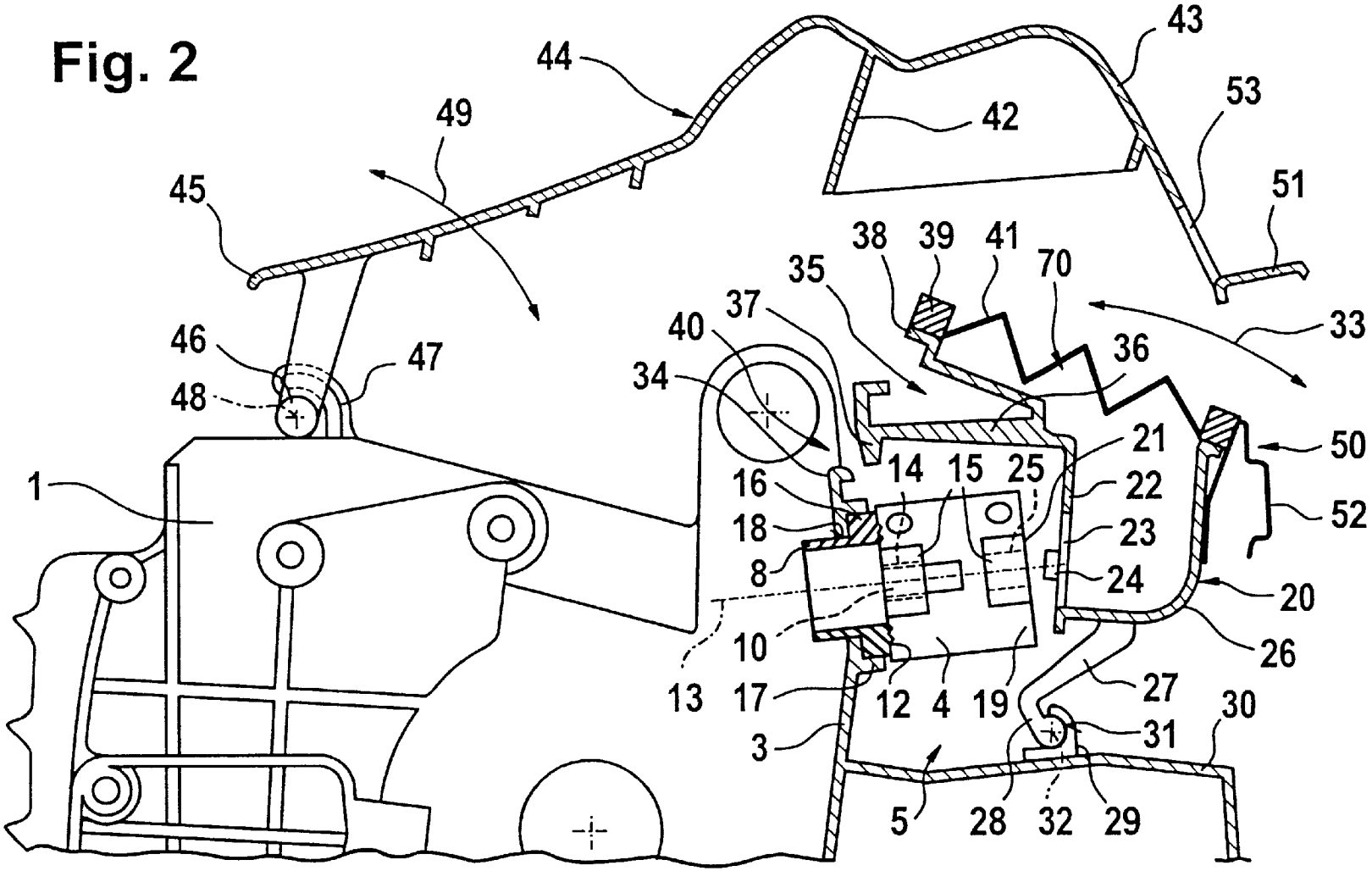
FIG. 2 is a schematic of the embodiment shown in FIG. 1 with a partially assembled carburetor.
Figure 3:
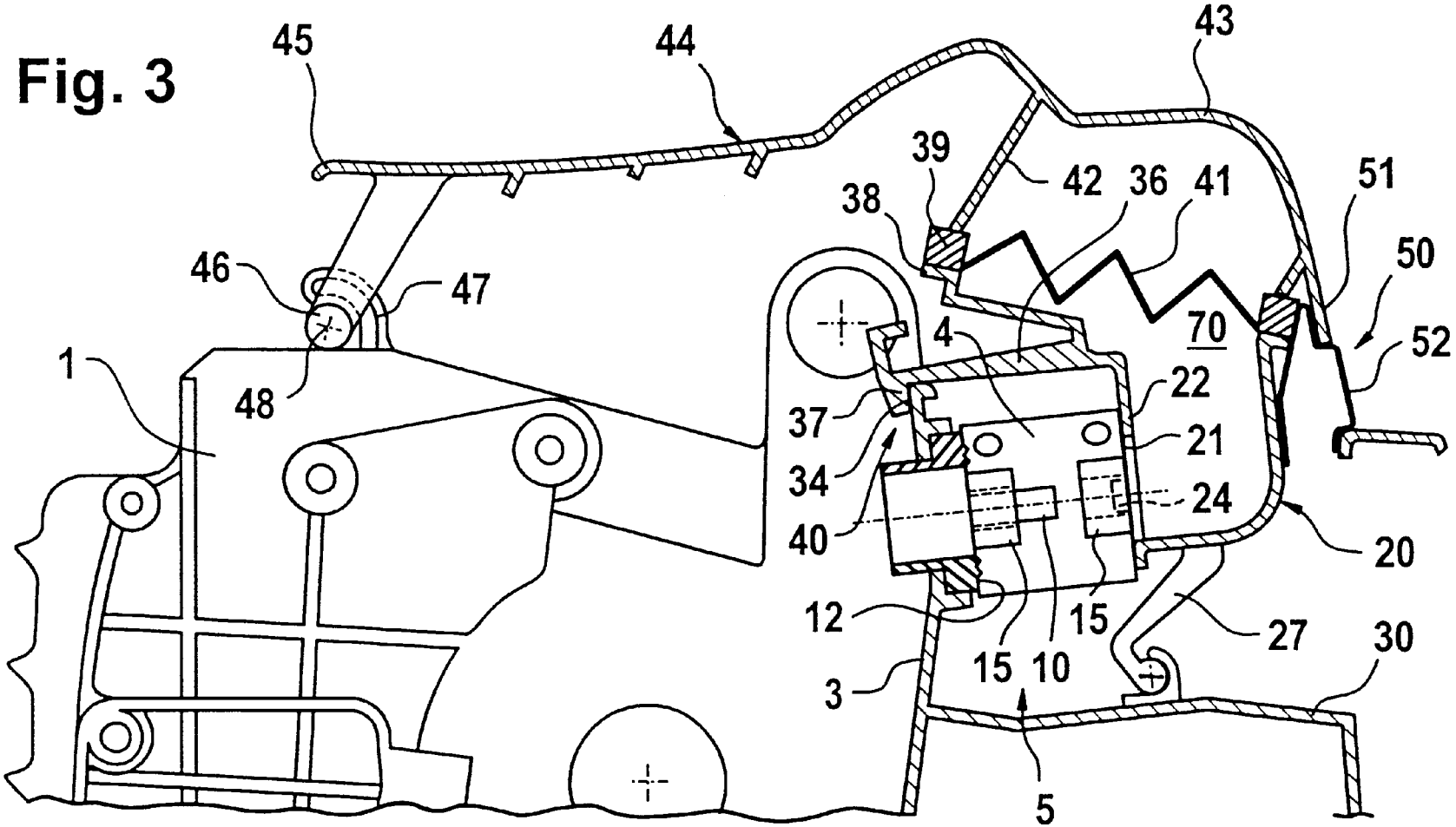
FIG. 3 is a further view of the embodiment of FIG. 1 shown with a mounted carburetor arrangement which is operationally ready.
Figure 4:
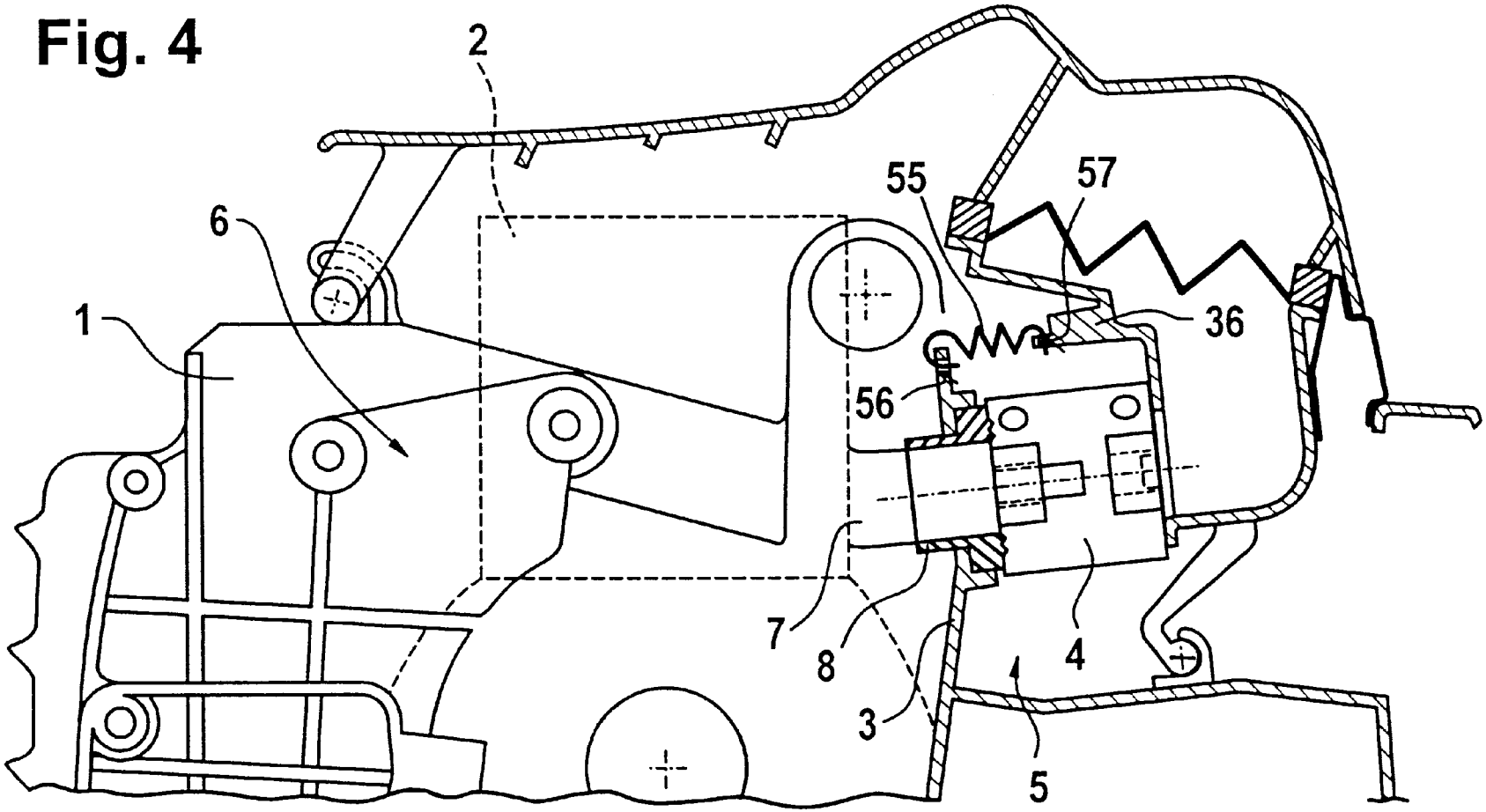
FIG. 4 is a variation of the embodiment of FIG. 3 wherein an air filter housing is fixed via a tension spring.
Figure 5:
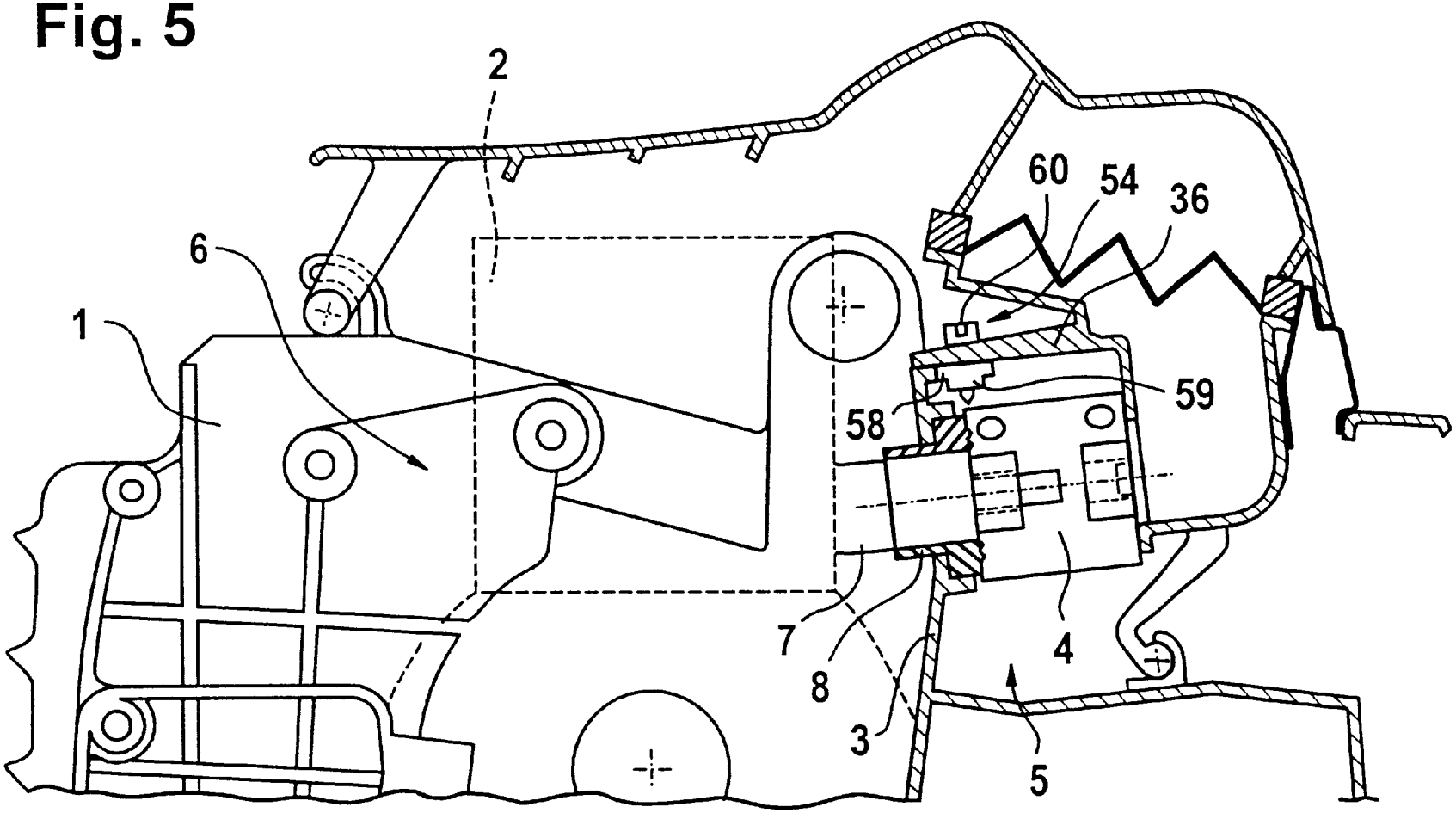
FIG. 5 is a further variation of the carburetor arrangement of the invention with a threaded fastener connection for uncovering the air filter housing; and, FIG. 6 is another embodiment of the arrangement of the invention wherein the air filter housing is mounted on mounting bolts common with the carburetor.
Figure 6:
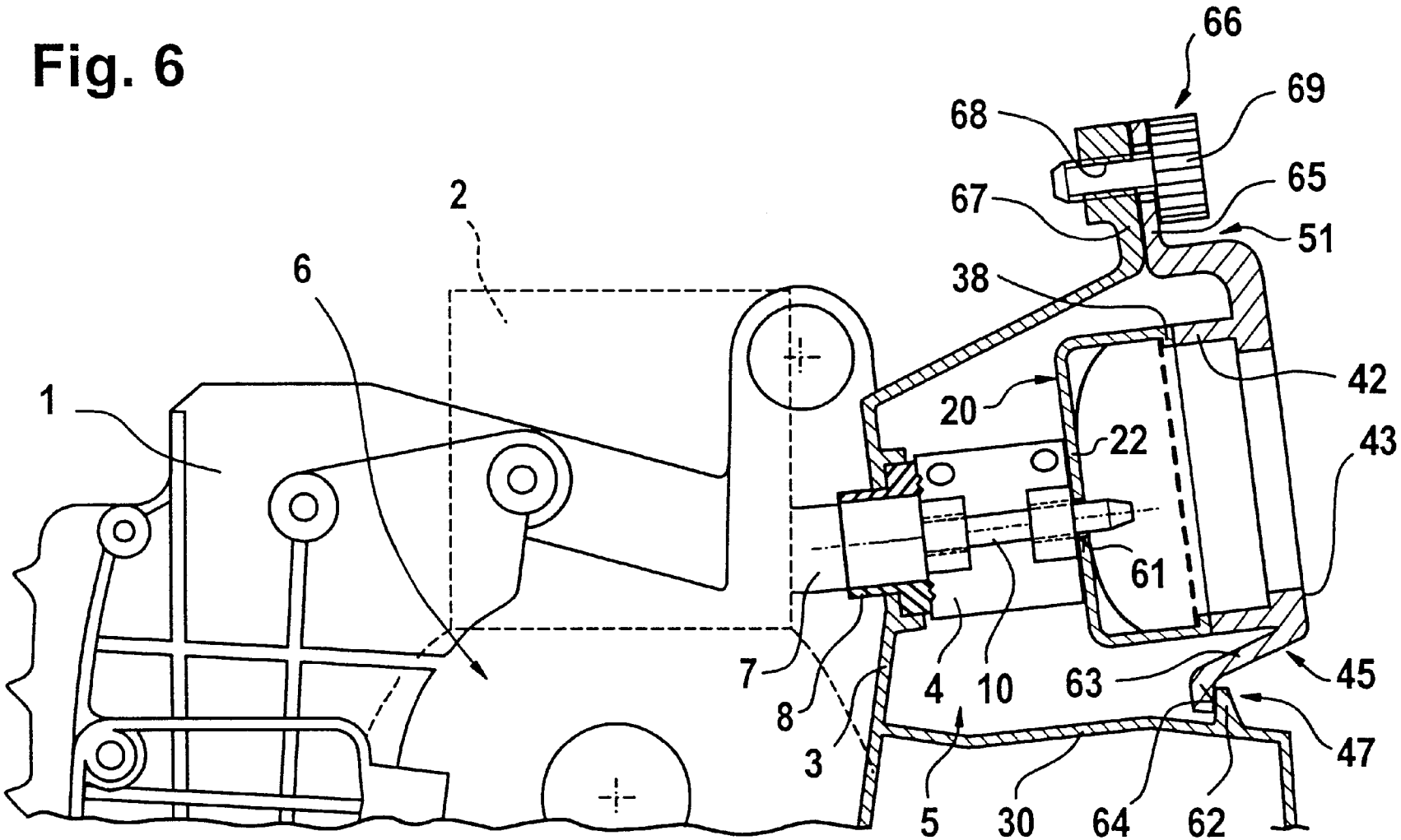

The internal combustion engine 2, which is mounted in the apparatus housing 1, is shown in phantom outline in the embodiment of FIGS. 1 to 3 and the additional embodiments shown in FIGS. 4 to 6.

Walls are provided within the apparatus housing 1 and are preferably configured as one piece with the housing. These walls partition a carburetor space 5 from the engine space 6 for accommodating the engine 2. A partition wall 3 of this kind lies between the engine 2 and a carburetor 4 mounted in the carburetor space 5. The partition wall 3 essentially functions to protect the carburetor 4 against the thermal influences of the engine 2.

The intake channel section 9 of the carburetor 4 is connected via a connecting tube 8 with the inlet channel 7 of the engine in order to conduct the mixture formed in the carburetor 4 to the engine 2. The connecting tube 8 is configured to be elastic in the embodiments shown. For this reason, a decoupling of the carburetor 4 with respect to vibration from the engine 2 is achieved.

As shown in FIG. 1, guide bolts 10 are provided on the side of the partition wall 3 facing toward the carburetor space 5. The guide bolts 10 stand approximately perpendicular to a support surface 11 on which the end face 12 of the carburetor 4 comes into contact engagement. Two guide bolts 10 are provided for centering the carburetor 4 and these bolts together with a longitudinal center axis 13 of the intake channel section 9 lie in a plane. The guide bolts 10 thereby lie diametrically to the longitudinal center axis 13 on both sides of the intake channel section 9.

As shown in FIG. 1, the partition wall 3 is reinforced in the region of the mounting surface 11 in order to accommodate the clamping forces which will be described hereinafter. The guide bolts 10 and the partition wall 3 are advantageously made of plastic and are especially made as one piece of plastic.

As shown in FIG. 2, the carburetor 4 is mounted on the guide bolts 10. The guide bolts 10 engage in bores 14 of the carburetor 4 whereby a centering of the carburetor with respect to the connecting tube 8 is ensured. As FIG. 2 also shows, the guide bolts 10 are made shorter than the length of the carburetor measured in the direction of the longitudinal center axis 13. In the embodiment, the guide bolts 10 are only approximately half as long as the intake channel section 9 which passes through the carburetor 4 as shown in FIG. 1. The bores 14 for accommodating the bolts 10 are formed in lateral flanges 15 of the carburetor 4. In the embodiment shown, the carburetor is advantageously a membrane carburetor.

The connecting tube 8 has a flange-like expanded end 16 which is seated in an annularly-shaped receptacle 17 of the partition wall 3. The connecting tube 8 is thus inserted from the carburetor space 5 through the opening 18 of the partition wall 3. The flange-like end 16 is centered in the receptacle 17 and projects beyond the edge of the receptacle. In this way, the flange-like end 16 forms an axially pretensioned sealing means between the partition wall 3 and the end wall 12 of the carburetor 4 and this is so because of the elastic material of the connecting tube 8. The sealing means can also be a paper or an elastomeric seal of which the elastomeric seal can be vulcanized to the end face 12 of the carburetor or to the partition wall 3 or the elastomeric seal can be configured as a loose O-ring. The end face 12 can also have a cylindrical or conical recess or rise which presses the sealing means with a radial and/or an axial component. Furthermore, a sealing action between the end face 12 of the carburetor 4 and the connecting tube 8 can be achieved with a contact surface, which is configured to be planar or conical, while omitting additional sealing means.

At the other end 19 of the carburetor 4, an intake filter 70 is connected which includes an air filter housing 20 and a filter element 41 placed therein. The end face 21 of the carburetor 4 faces toward the intake filter 70 and lies on a corresponding wall 22 of the air filter housing 20. Centering means are likewise arranged between the end face 21 of the carburetor 4 and the wall 22 of the air filter housing 20 in order to place the flow opening 23 in the correct position relative to the intake channel section 9. The centering means engage in corresponding centering openings of the carburetor.

At least one cylinder stub 24 is provided on the wall 22 in the embodiment shown. Preferably, two cylinder stubs 24 are provided which lie diametrically to the longitudinal center axis 13 of the intake channel section 9. The cylinder stubs 24 engage in corresponding centering openings 25 in lateral flanges 15 of the carburetor 4 on both sides of the intake channel section 9. The centering means can be configured on one of the two end faces (12, 21) of the carburetor 4 or on both end faces. The centering means on one of the two end faces (12, 21) of the carburetor 4 or on both end faces thereof can also be so configured that guide bolts 10 or cylinder stubs 24 are provided on the carburetor 4 which engage in corresponding openings fixed on the housing. A centering is also possible via centering rings or housing-fixed ribs which surround the carburetor 4 around the periphery thereof. The centering rings lie inwardly or outwardly with respect to the carburetor 4.

The air filter housing 20 is configured to be approximately L-shaped when view in section. The air filter housing 20 is provided with a pivot arm 27 in the region of a leg 26 and the free end 28 of the arm 27 is expanded spherical-like or roller-like. The free end 28 engages into the support opening 31 of a support location 29. The support location 29 can be provided as a support element made of plastic or metal on the base 30 of the carburetor space 5 and is attached with threaded fasteners, welded or fixed with adhesive. The support opening 31 faces the partition wall 3.

The free end 28 of the pivot arm 27 is seated in the support opening 31 or latched therein so that the air filter housing 30 can be pivoted about the pivot axis 32 in the direction toward the partition wall 3 or can be pivoted away from the partition wall as indicated by the double arrow 33. The pivot axis 32 lies transversely to the longitudinal center axis 13 of the intake channel section 9 and is especially at right angles to this longitudinal center axis 13.

To assemble the air filter housing 20, the housing 20 is pivoted in the direction toward the partition wall 3 until the wall 22 of the air filter housing 20 comes in tight contact engagement against the end face 21 of the carburetor 4. A sealing element is advantageously arranged between the end face 21 and the wall 22 in order to prevent the intake of unwanted air.

A latching arm 36 is mounted on the air filter housing 20 in the region of the other leg 35. A latch hook 37 is provided at the free end of the latching arm 36. The latch hook 37 together with a latch edge 34 of the partition wall 3 conjointly define a latching device 40 via which the air filter housing 20 is latched to the housing as shown in FIG. 3. For this purpose, the air filter housing 20 is pivoted so far in the direction of partition wall 3 until the latch hook 37 engages behind the latch edge 34 of the partition wall 3.

Advantageously, the latch hook 37 extends over a segment length of the latch edge 34 so that a reliable support of the built-up clamping forces is ensured over a wide latch segment.

In the embodiment of FIG. 4, the air filter housing 20 is latched alternatively via a tension spring 55 in the operating position. The tension spring 55 is hooked into respective bores (56, 57) in the partition wall 3 and the latching arm 36 at its respective ends. A further latching possibility is presented in FIG. 5 with a threaded-fastener connection 54 between the latching arm 36 and the partition wall 3. In the embodiment shown here, a bent-over portion 58 is provided on the partition wall 3 having a thickening 59 for accommodating a sheet metal screw 60. In lieu of the sheet metal screw 60, a threaded fastener with a nut, a snap catch or the like can be provided.

The elastic deformations, which result when latching the air filter housing 20, generate a clamping force. This clamping force holds the carburetor 4 clamped in the longitudinal direction of the intake channel section 9 reliably between the partition wall 3 and the wall 22 of the air filter housing 20. Also, elastic spring elements can be additionally provided between the carburetor 4 and the partition walls 3 and 22 to increase the clamping force. The carburetor 4 is fixed tightly into the housing in its mounted position. The sealing forces are simultaneously built up by the clamping forces. On the end faces 12 and 21 of the carburetor 4, these sealing forces ensure a tight contact engagement against the supporting surfaces of the partition walls 3 and 22. Sealing means can be provided to increase the sealing action between the end face 21 and the partition wall 22 as described for the end face 12.

Preferably, the air filter housing 20, its pivot arm 27, the latching arm 36 and, if required, the latch hook 37 are all made of plastic and are preferably made as one piece of plastic.

The housing-fixed latched air filter housing 20 is open on the side facing away from the base 30 and is provided with a peripheral edge 38 on which a seal frame 39 of an areal filter element 41 is placed. The filter element 41 is fixed in its position by a holder 42 configured to correspond to the frame 38. The holder 42 is formed on an air filter cover 43. The air filter cover 43 is part of a hood 44 closing the apparatus housing 1. The hood 44 is held at its end 45 facing away from the carburetor space 5 by a pivot bolt 46 in housing-fixed bearings 47. In FIG. 2, the hood or cover 44 is opened and closed in the direction of the double arrow 49 about the pin axis 48. In its closed position as shown in FIG. 3, the cover 44 is fixed tightly to the housing at its other end 51 via a latch device 50.

The latch device 50 comprises a latching member which is provided on the air filter housing 20 and is configured as a latch tongue 52 in the embodiment shown. The latch tongue 52 engages in a latch opening 53 (FIG. 2) of the air filter cover 43. In the operating position shown, the seal frame 39 is held by the holder 42 tightly against the peripheral edge 38 of the air filter housing 20. The latch device 50 can also be provided on the apparatus housing 1 and especially in the region of the partition wall 3.

FIG. 6 shows another embodiment wherein the guide bolts 10 are mounted as shown in the embodiment of FIG. 1 but configured longer than the length of the carburetor 4 measured in the direction of the longitudinal axis 13 (FIG. 1). The carburetor 4 has two flanges 15 on respective sides and these flanges have bores 14 which permit the carburetor to be threaded onto the guide bolts 10. The air filter housing 20 includes two bores 61 which likewise facilitate threading the air filter housing onto the guide bolts 10.

A projection 62 is arranged on the base 30 as a support 47 for the air filter cover 43 and is preferably configured as one piece with the base 30. The air filter cover 43 has a holding arm 63 on its end 45 facing toward the base 30. The arm 63 has an edge 64 which engages behind the projection 62 and has a flange 65 at the opposite-lying end 51 for a threaded-fastener connection 66. The partition wall 3 is bent over in the direction of the flange 65 and likewise includes a flange 67 having a threaded bore 68. The threaded bore 68 can be provided by injection molding in the flange 65 or can be configured as a separate nut which is placed, riveted or attached with adhesive. In the latched state of the air filter cover 43, the two flanges (65, 67) lie flush against each other and are held by a knurled screw 69. A latch connection or bayonet connection or the like can be provided in lieu of the knurled screw 69.

The holder 42 of the air filter cover 43 lies on the edge 38 of the air filter housing 20. The clamping forces are generated via the holder 42 and the air filter housing 20 by tightening the threaded-fastener connection 66 and the elastic deformations associated therewith. The clamping forces hold the carburetor 4 between the partition wall 3 and the wall 22 of the air filter housing 20.

It is understood that the foregoing description is that of the preferred embodiments of the invention and that various changes and modifications may be made thereto without departing from the spirit and scope of the invention as defined in the appended claims.

What is claimed is:

1. A carburetor arrangement in a work apparatus with an internal combustion engine having an inlet channel, the carburetor arrangement comprising:

an apparatus housing defining a space for mounting said engine therein;

a carburetor having an intake channel extending therethrough and said intake channel defining a longitudinal axis;

a partition wall disposed between said engine and said carburetor and said carburetor being positioned on said partition wall;

said intake channel having a first end facing toward said partition wall and a second end facing away from said partition wall;

a connecting tube projecting through said partition wall to connect said inlet channel of said engine to said intake channel of said carburetor at said first end thereof;

an intake air filter communicating with said second end of said carburetor for conducting combustion air thereto;

an additional wall; and, means for clamping and holding said carburetor between said partition and additional walls in the direction of said longitudinal axis.

2. The carburetor arrangement of claim 1, wherein said partition wall is part of said apparatus housing.

3. The carburetor arrangement of claim 1, said carburetor being a membrane carburetor.

4. A carburetor arrangement in a work apparatus with an internal combustion engine having an inlet channel, the carburetor arrangement comprising:

an apparatus housing defining a space for mounting said engine therein;

a carburetor having an intake channel extending therethrough and said intake channel defining a longitudinal axis;

a partition wall disposed between said engine and said carburetor and said carburetor being positioned on said partition wall;

said intake channel having a first end facing toward said partition wall and a second end facing away from said partition wall;

a connecting tube projecting through said partition wall to connect said inlet channel of said engine to said intake channel of said carburetor at said first end thereof;

an intake air filter communicating with said second end of said carburetor for conducting combustion air thereto;

an additional wall;

means for clamping and holding said carburetor between said partition and additional walls in the direction of said longitudinal axis;

said intake air filter being an intake air filter assembly including an air filter housing including aid additional wall as a wall thereof; and, said carburetor arrangement further comprising a support on said housing; said air filter housing being mounted on said support; and, said means including one of the following for latching said air filter housing securely in said apparatus housing: a tension spring, a threaded fastener connection or a latch connection.

5. The carburetor arrangement of claim 4, wherein said air filter housing is pivotally connected to said support; and, wherein said latch connection comprises: a latch edge formed on said partition wall; a latch arm provided on said air filter housing; and, said latch arm including a latch hook on the end of said latch arm for hooking behind said latch edge to securely hold said air filter housing so as to clamp and hold said carburetor between said partition wall and said additional wall.

6. The carburetor arrangement of claim 5, said air filter housing having a pivot arm thereon for holding said air filter housing on said support.

7. The carburetor arrangement of claim 6, wherein said air filter housing, said latch arm, said pivot arm and said latch hook are a single integral piece made of plastic.

8. The carburetor arrangement of claim 4, further comprising an air filter cover for closing and opening said air filter housing; said air filter cover having an end; a pivot support fixedly mounted on said apparatus housing; and, said air filter cover being pivotally connected to said pivot support so as to permit said air filter cover to be pivotally movable for opening and closing said air filter housing.

9. The carburetor arrangement of claim 8, said end of said air filter cover being a first end; and, said air filter cover having a second end; and, said carburetor arrangement further comprising: releasable fixing means for releasably fixing said air filter cover to said apparatus housing at said second end of said air filter cover.

10. The carburetor arrangement of claim 9, said releasable fixing means including one of a threaded fastener connection or a latch device.

11. The carburetor arrangement of claim 10, wherein said latch device includes a latch member provided on said air filter housing; and, a latch opening formed in said air filter cover for receiving said latch member in latching engagement when said air filter cover is closed.

12. The carburetor arrangement of claim 11, said latch member being a latch tongue on said air filter housing.

13. The carburetor arrangement of claim 8, said air filter assembly comprising an air filter and a hold-down element disposed on said air filter cover for holding said air filter in place when said air filter cover is closed.

14. The carburetor arrangement of claim 13, wherein said air filter is a filter element having a sealing edge; and, said hold-down element being in contact engagement with said sealing edge when said air filter cover is closed.

15. A carburetor arrangement in a work apparatus with an internal combustion engine having an inlet channel, the carburetor arrangement comprising:

an apparatus housing defining a space for mounting said engine therein;

a carburetor having an intake channel extending therethrough and said intake channel defining a longitudinal axis;

a partition wall disposed between said engine and said carburetor and said carburetor being positioned on said partition wall;

said intake channel having a first end facing toward said partition wall and a second end facing away from said partition wall;

a connecting tube projecting through said partition wall to connect said inlet channel of said engine to said intake channel of said carburetor at said first end thereof;

an intake air filter communicating with said second end of said carburetor for conducting combustion air thereto;

an additional wall;

means for clamping and holding said carburetor between said partition and additional walls in the direction of said longitudinal axis;

centering means on at least one of said walls; and, said carburetor having centering openings formed thereon for receiving said centering means therein.

16. The carburetor arrangement of claim 15, wherein said centering means includes guide bolts on said partition wall for engaging corresponding ones of said centering openings of said carburetor.

17. The carburetor arrangement of claim 16, wherein said guide bolts and said partition wall are configured as an integral piece made of plastic.

18. A carburetor arrangement in a work apparatus with an internal combustion engine having an inlet channel, the carburetor arrangement comprising:

an apparatus housing defining a space for mounting said engine therein;

a carburetor having an intake channel extending therethrough and said intake channel defining a longitudinal axis;

a partition wall disposed between said engine and said carburetor and said carburetor being positioned on said partition wall;

said intake channel having a first end facing toward said partition wall and a second end facing away from said partition wall;

a connecting tube projecting through said partition wall to connect said inlet channel of said engine to said intake channel of said carburetor at said first end thereof;

an intake air filter communicating with said second end of said carburetor for conducting combustion air thereto;

an additional wall;

means for clamping and holding said carburetor between said partition and additional walls in the direction of said longitudinal axis;

a first seal disposed between said carburetor and said partition wall and a second seal disposed between said carburetor and said additional wall.

19. The carburetor arrangement of claim 18, wherein said connecting tube is made of an elastic material and said connecting tube has a flanged end in contact engagement with said carburetor to define said first seal.

* * * * *